US006591771B2

(12) United States Patent
Greghi

(10) Patent No.: US 6,591,771 B2
(45) Date of Patent: Jul. 15, 2003

(54) DEVICE FOR WINDING SAILS

(76) Inventor: Renzo Greghi, Via Marostica, 31, 20146 Milano (IT)

( * ) Notice: Subject to any disclaimer, the term of this patent is extended or adjusted under 35 U.S.C. 154(b) by 0 days.

(21) Appl. No.: 10/075,860

(22) Filed: Feb. 13, 2002

(65) Prior Publication Data

US 2002/0129754 A1 Sep. 19, 2002

(30) Foreign Application Priority Data

Mar. 15, 2001 (IT) ..... MI2001148 U

(51) Int. Cl.[7] ..... B63H 9/04
(52) U.S. Cl. ..... 114/106
(58) Field of Search ..... 114/102.1, 102.15, 114/102.3, 104, 105, 106, 107

(56) References Cited

U.S. PATENT DOCUMENTS

| | | | | | |
|---|---|---|---|---|---|
| 3,872,816 | A | * | 3/1975 | Cutts | 114/106 |
| 4,248,281 | A | * | 2/1981 | Hood | 114/106 |
| 4,376,417 | A | * | 3/1983 | Blonski | 114/106 |
| 4,573,424 | A | * | 3/1986 | Clausin | 114/106 |
| 5,014,637 | A | * | 5/1991 | Stevenson, IV | 114/106 |

* cited by examiner

*Primary Examiner*—Stephen Avila
(74) *Attorney, Agent, or Firm*—Hedman & Costigan, P.C.

(57) ABSTRACT

A device for winding sails comprises at least an outer contoured element wound on and made rigid with an inner contoured element for transmitting a torque required for winding a sail being wound on the outer contoured element. The device allows to wind and unwind large size sails, for bearing arrangements, such as asymmetrical spinnakers, or sails of a same type, such as gennakers or MPS's.

2 Claims, 3 Drawing Sheets

DEVICE FOR WINDING SAILS

BACKGROUND OF THE INVENTION

The present invention relates to a device for winding sails.

More specifically the present invention relates to a device for winding large-size bow sails, for bearing or supporting sail arrangements, such as asymmetrical spinnakers or sails of a same type, such as gennakers or MPS's.

As is known, a very important problem for sailors sailing with a reduced equipment, is that of handling bow sails of large size (for example of the above mentioned types).

The most frequently adopted prior solution, for facilitating the sail handling, in raising and lowering the bow sails, for bearing large size arrangements, is that of using a specifically designed jig, called "socking", holding a sail clamped therein.

The above mentioned jig usually comprises: a funnel element, made of an ABS material, rigid with the socking and coupled to a reciprocating sheet circuit; a head block; and a sheet circuit re-connected to the head block, in order to handle the ABS funnel element from the boat deck.

To said block is anchored a strop, to which the sail head and upper part of the socking are coupled.

The socking is raised up to the head of the mast, and the bottom of the sail is coupled to the tack point and anchored to the controlling sheet.

The maneuvering allowing an asymmetric spinnaker to be inflated consists of operating the reciprocating circuit sheet, to cause the funnel element to be raised to the head of the mast, while pressing the stocking and freeing the sail.

In order to close the sail, the reciprocating circuit sheet is maneuvered in a reverse direction, to cause the funnel element to be lowered so as to fully distend the socking clamping the sail.

The jigs according to the status of the art, however, tend to hinder the maneuverings depending on the wind force.

In particular, the sailor who must perform the maneuvering must move to the bow of the boat, where the operating safety is less, and must maneuver the reciprocating circuit sheets in order to displace downward the funnel element, if the sail must be clamped, or upward, if the sail must be freed.

The sheets must be easily accessible, and they must not be wound about the sail inside the socking.

The locking of the reciprocating circuit makes very dangerous the operation for freeing or clamping the sail, both because of the unstable equilibrium conditions affecting the sailor, both because of a possible anomalous performance of the sail which, if it is not properly tensioned in its working position, can be abruptly deflated and re-inflated again.

Thus, the drawback associated with a locking of the maneuvering circuit, is, as stated, very dangerous and difficult to be properly solved, and compels the sailor to perform emergency operations for recovering the sail.

The prior art discloses further winding jigs for winding asymmetrical sails.

All the prior arrangements provide to design and construct the sail to fit the features of the specific winding systems.

In actual practice, there are designed very lean sails, such as drifters and reachers, which can be easily wound, for a boat operation with the wind blowing on the bow-side of the cross-member.

In this case, the sails are wound on the contoured element, and are rigid therewith, to be properly tensioned between the tack point and the halyard.

The above mentioned systems are specifically suitable for very swift boats, catamarans or single-shell boats, of very small weight and planning type, for which the wind blows usually at the bow side of the cross-member.

In no case the above mentioned systems are suitable to wind sails for bearing paces, such as asymmetrical spinnakers of standard construction or sails of the same types such as gennakers or MPS's.

SUMMARY OF THE INVENTION

Accordingly, the aim of the present invention is to provide such a device allowing to wind and unwind sails for bearing paces, such as asymmetrical spinnakers, or like sails, as gennakers or MPS's having a standard construction.

Within the scope of the above mentioned aim, a main object of the present invention is to provide such an easily used device allowing to raise and lower the sail in a very simple manner, on boats controlled by a controlling crew including a small number of controlling persons.

Yet another object is to provide a combined winding device—flexible sail arrangement having a very small volume to be easily stored.

Yet another object of the present invention is to allow a sail to be easily wind on a contoured element without applying any winding torque, to prevent the sail from being stretched or torn.

Yet another object of the present invention is to allow the sail to be easily freed or clamped from the boat pit which is the safest position on the boat.

Yet another object of the present invention is to provide such a sail winding/unwinding device which can be made by using easily commercially available elements and materials.

According to one aspect of the present invention, the above mentioned aim and objects, as well as yet other objects, which will become more apparent thereinafter, are achieved by a sail winding device, characterized in that said sail winding device comprises at least an outer contoured element encompassing an inner contoured element for transmitting a sail winding torque, and in that said device further comprises at least a sheath contoured element, on which said sail is wound.

BRIEF DESCRIPTION OF THE DRAWINGS

Further characteristics and advantages of the present invention will become more apparent hereinafter from the following detailed disclosure of a preferred, though not exclusive, embodiment of the invention, which is illustrated, by way of an indicative, but not limitative example, in the accompanying drawings, where.

DESCRIPTION OF THE PREFERRED EMBODIMENTS

Figure 1:
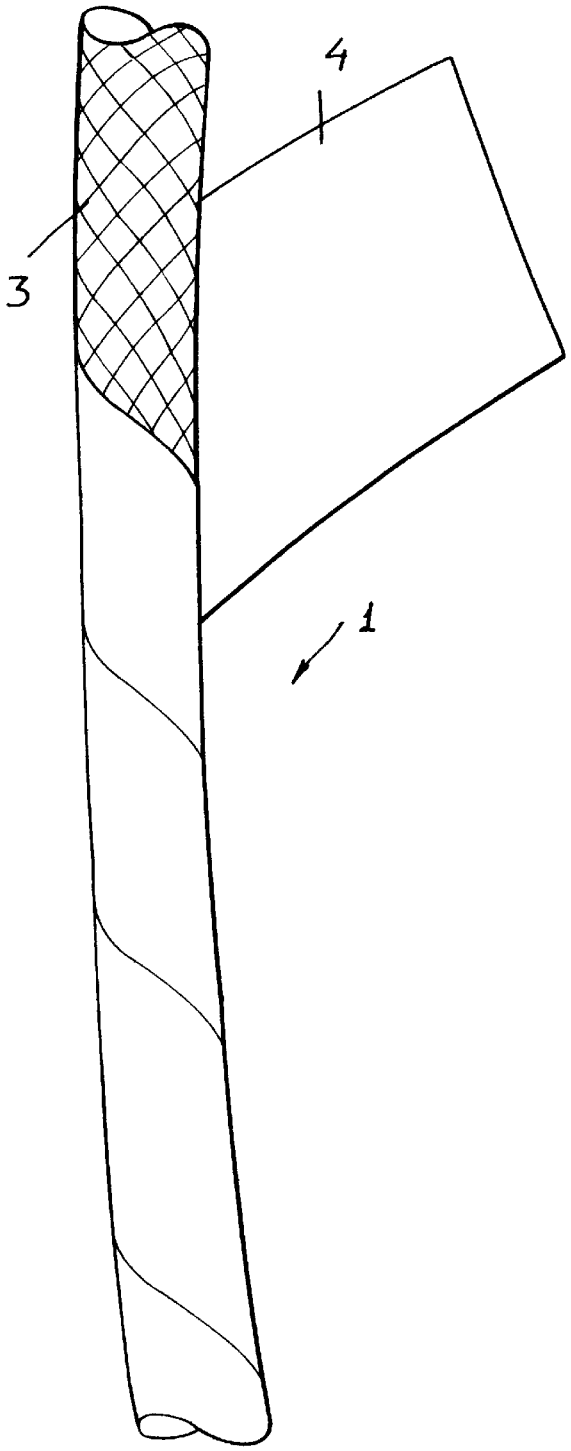
FIG. 1 is a schematic view of the sail winding device according to the present invention, being shown in a condition thereof in which the outer contoured element is partially wound on the inner contoured element and with a detached flap.
Figure 2:
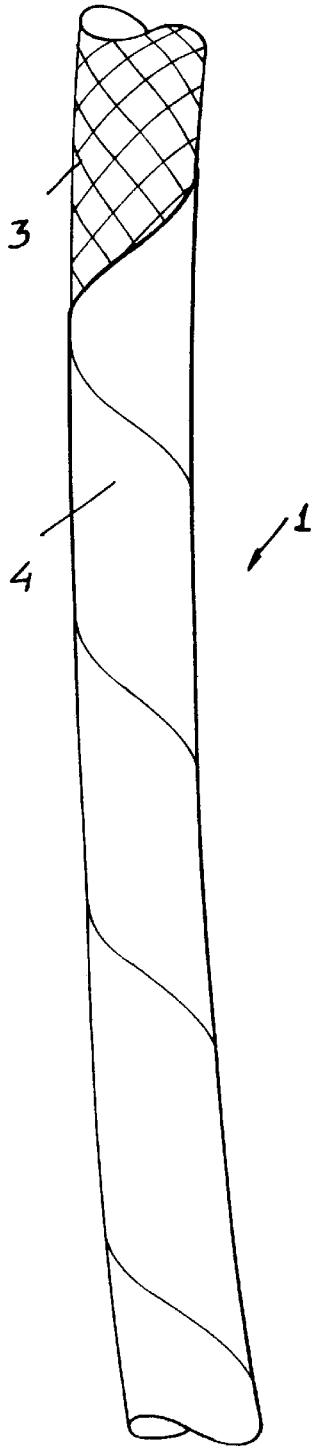
FIG. 2 is a further schematic view, similar to FIG. 1, illustrating the sail winding device according to the invention, with the outer contoured element being rigid with the inner contoured element.

With reference to the number references of the above mentioned figures, the sail winding device, according to the present invention, which has been generally indicated by the reference number 1, comprises an outer contoured element 4, wound on or encompassing an inner contoured element 3, designed for transmitting thereto a torque required for winding a sail 9.

The device further comprises a so-called sheath contoured element 7, arranged outside of the mentioned contoured elements 3 and 4.

The inner contoured element 3 comprises, for example, a sheet or rope, whereas the outer contoured element 4 comprises, for example, a flexible strip wound on the sheet and made rigid therewith.

The sheath contoured element 7, in turn, comprises, for example, a flexible strip, having a suitable size and a tubular configuration, the thickness of which is increased by a plastics material film.

The sail winding device 1, in particular, can be applied to a sail winding system comprising, as main components thereof, a rotatable head 2, including a halyard attachment end portion 21, an inner contoured element attachment end portion 22, a asymmetric rudder sail rotary spring catch 23 and a stop or detent element 24.

The detent element 24 prevents the torque provided by the winding system from subjecting to torsion the halyard.

The inner contoured element 3, made rigid with the outer contoured element 4 of the winding device 1, is coupled to the rotary head 2 by a fitting 31 and being coupled to a winder 6 by a fitting 32.

The sheath contoured element 7 is coupled to the inner contoured element 3 rigid with the outer contoured element 4 only at the head point 77.

The winder 6 comprises an attachment fitting 61 for coupling to the boat deck (not shown), and a continuous winding system 63 including a rope circuit 64 for winding or unwinding the sail.

On the winder 6 is supported a rotary base 5, including a spring catch 51 for the asymmetric sail base.

The rope continuous circuit 64 is looped to the boat pit by a suitable looping system, of a per se known type.

The operating principle of the disclosed system is based, from a dynamic standpoint, on winding the sail, starting from the sail head, under the torque applied to the rotary head 2 by the inner contoured element 3 rigid with the outer contoured element 4 transmitting the operating torque.

Said outer contoured element 4, in particular, is driven by the winder 6 which, in turn, is driven from the boat pit by the rope circuit 64, whereas the spring catch 51 of the sail does not follow the winding movement, since it is rigid with the rotary base 5.

Thus, the sail is wound on the sheath contoured element 7, driven by the spring catch 23, the sheath 7 being in turn driven by the rudder point 77.

The sail winding is performed from the top to the bottom: in other words, it is at first wound the head portion of the sail and then the central portion of the sail, up to entrain the rotary point 51 of the sail base.

The sail portion coupled to the control rope 8 is consequently wound, by operating the winding system.

The operating principle of the system, during the sail unwinding, is based, from a dynamic standpoint, on the sail deployment action starting from the pulling force provided by the control rope 8.

The inner contoured element 3, made rigid with the outer contoured element 4, while holding the required flexibility during the sail storing operation, is adapted to provide the required torque to the rotary head 2, with a "delay" of few revolutions.

In particular, the sheath contoured element 7 is designed for winding the sail, without deforming or tearing it, both during the winding operation, and during the storing of the sail to a rest condition.

In particular, the sheath contoured element 7 is so designed as to provide the torque for unwinding the sail, while removing the control rope 8 from the rotary center thereat said sail is wound.

The winding device 1 comprises, as stated, an inner contoured element 3, constituted, for example, by a rope, and an outer contoured element 4 constituted, for example, by a flexible strip wound on the rope and made rigid therewith.

Figure 3:
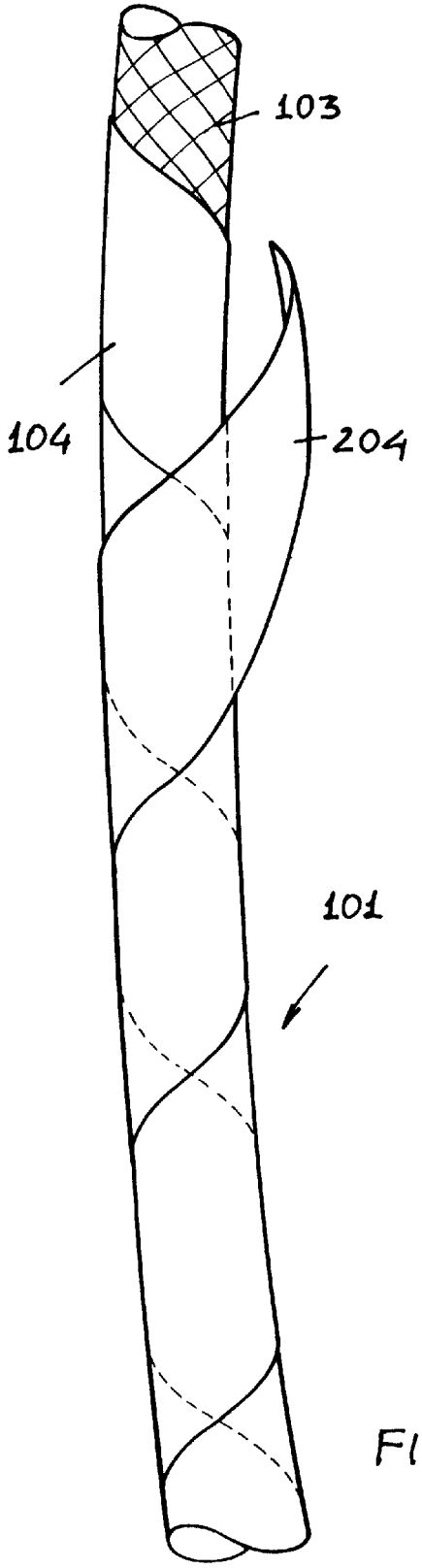
FIG. 3 is a further schematic view similar to the preceding views, and showing a sail winding device including two crossed outer contoured elements.
Figure 4:
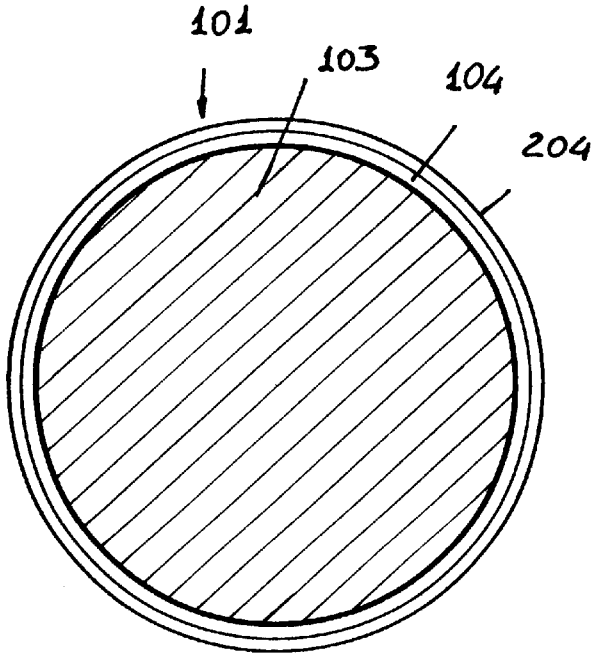
FIG. 4 is a cross sectional view of the sail winding device according to the invention.

FIGS. 3 and 4 show a sail winding device 1 comprising two cross tiers of outer contoured elements 104 and 204, wound on an inner contoured element 103.

The number and arrangement of the outer contoured elements will depend on the desired flexibility and, in general, on the required characteristics, according to the type of sails to be used and according to the boat to which the device is applied.

Figure 5:
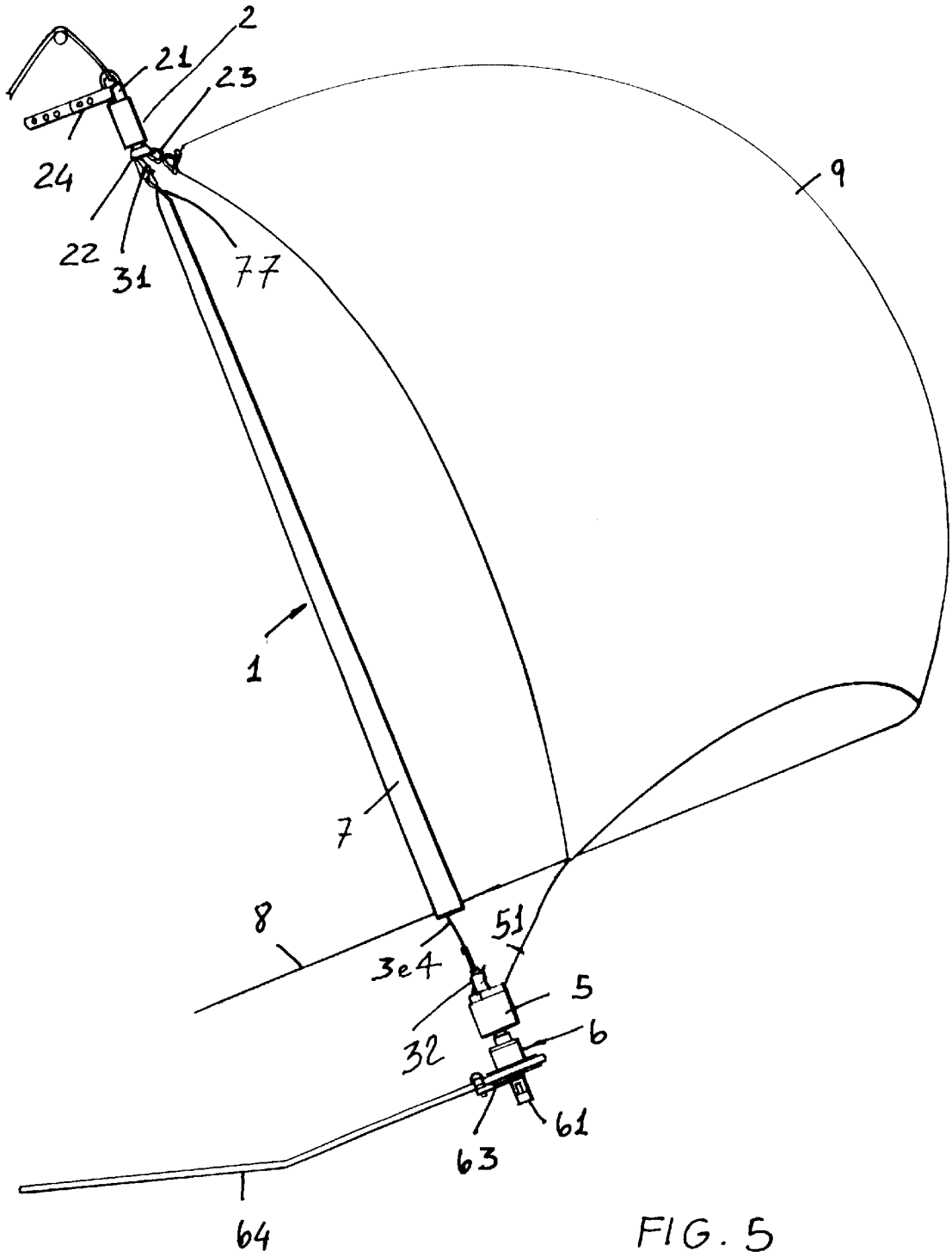
FIG. 5 is a schematic side elevation view of the device applied to a boat sail.

The sheath contoured element 7 can assume a conic configuration, having its base downward directed, as schematically shown in FIG. 5, in order to allow the sails to be easily wound and unwound.

It has been found that the sail winding device according to the invention fully achieves the intended aim and objects.

In fact, the inventive sail winding/unwinding device allows to easily wind/unwind sails for bearing paces, such as asymmetrical spinnakers, or the like sails, such as gennakers or MPS's, of standard construction.

The device according to the invention, as mentioned, can be easily used and allows to simply raise an lower the boat sails, even if the boat crew comprises a small number of persons.

Moreover, the inventive device remarkably improves the safety for the boat crew during the sail maneuvering operations, in particular for large size sails such as asymmetrical spinnakers or the like sail arrangements, such as gennakers or MPS's.

A further important advantage of the inventive device is that it greatly simplify the boat maneuvers while providing a great operating safety for the boat crew.

The above mentioned characteristics would allow the boat crew to use much more frequently the intended sails.

In practicing the invention, the used materials, as well as the contingent size and shapes, can be any, depending on requirements and the status of the art.

What is claimed is:

1. A sail winding device, comprising at least an outer contoured element encompassing and made rigid with an inner contoured element designed for transmitting a winding torque to a sail being wound on a sheath contoured element, wherein said outer contoured element comprises a flexible strip wound on said inner contoured element and made rigid therewith.

2. A sail winding device, according to claim 1, wherein said device comprises two crossed tiers of said outer contoured elements wound on said inner contoured element.

* * * * *